US010348048B2

(12) United States Patent
Esmaeili et al.

(10) Patent No.: US 10,348,048 B2
(45) Date of Patent: Jul. 9, 2019

(54) USE AND APPLICATION METHOD OF DIELECTRIC LUBRICANT IN AN ELECTRICAL CONNECTOR

(71) Applicant: Apple Inc., Cupertino, CA (US)

(72) Inventors: Hani Esmaeili, Santa Clara, CA (US); Jason S. Sloey, Cedar Park, TX (US); Eric S. Jol, San Jose, CA (US); Daniel C. Wagman, Scotts Valley, CA (US); John B. Ardisana, II, Torrance, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/698,589

(22) Filed: Sep. 7, 2017

(65) Prior Publication Data

US 2018/0090898 A1 Mar. 29, 2018

Related U.S. Application Data

(60) Provisional application No. 62/399,177, filed on Sep. 23, 2016.

(51) Int. Cl.

| | |
|---|---|
| ***H01R 13/00*** | (2006.01) |
| ***H01R 43/00*** | (2006.01) |
| ***H01R 13/52*** | (2006.01) |
| ***H01R 43/26*** | (2006.01) |
| ***H01R 13/10*** | (2006.01) |
| ***H01R 24/62*** | (2011.01) |

(52) U.S. Cl.

CPC ..... *H01R 43/005* (2013.01); *H01R 13/10* (2013.01); *H01R 13/5216* (2013.01); *H01R 24/62* (2013.01); *H01R 43/26* (2013.01)

(58) Field of Classification Search

CPC ..... H01R 13/00; H01R 43/00

See application file for complete search history.

(56) References Cited

U.S. PATENT DOCUMENTS

| | | | |
|---|---|---|---|
| 4,909,751 A | 3/1990 | Marolda, Jr. | |
| 9,355,544 B1 * | 5/2016 | Bean | G08B 1/08 |

(Continued)

FOREIGN PATENT DOCUMENTS

WO 2016106370 A1 6/2016

OTHER PUBLICATIONS

"Loctite Liquid Optically Clear Adhesives for Touch Panels & Displays" Henkel, 2012 (Year: 2012).*

*Primary Examiner* — David P Turocy
*Assistant Examiner* — Mohammad Mayy
(74) *Attorney, Agent, or Firm* — Kilpatrick Townsend & Stockton LLP

(57) ABSTRACT

A method of applying a dielectric lubricant to an electrical connector of a consumer electronic device. The method includes inserting a dielectric lubricant delivery device apertures for delivering the dielectric lubricant to the electrical connector into a receptacle of the electronic device; applying pressure to a chamber including the dielectric lubricant, the chamber being fluidly coupled to the apertures of the lubricant delivery device such that the pressure causes the lubricant to enter the receptacle via the apertures and deposit on contacts of the electrical connector; and pulling vacuum using the lubricant delivery device to remove excess dielectric lubricant from the receptacle and the electrical connector.

18 Claims, 7 Drawing Sheets

(56) References Cited

U.S. PATENT DOCUMENTS

| | | | | |
|---|---|---|---|---|
| 2002/0031449 | A1* | 3/2002 | Loscher | B01L 3/5085 422/400 |
| 2003/0087448 | A1* | 5/2003 | Abe | G01F 1/684 436/73 |
| 2005/0035478 | A1* | 2/2005 | Sewell | B29C 70/443 264/102 |
| 2008/0248669 | A1 | 10/2008 | Wing et al. | |
| 2012/0097444 | A1* | 4/2012 | Hilberts | H01R 4/20 174/77 R |
| 2013/0115821 | A1* | 5/2013 | Golko | H01R 13/516 439/638 |
| 2014/0073201 | A1* | 3/2014 | Weber | H01R 43/24 439/736 |
| 2016/0064853 | A1* | 3/2016 | Fujimoto | B62D 5/0406 180/446 |
| 2016/0177680 | A1 | 6/2016 | Hatcher et al. | |

* cited by examiner

USE AND APPLICATION METHOD OF DIELECTRIC LUBRICANT IN AN ELECTRICAL CONNECTOR

CROSS-REFERENCES TO RELATED APPLICATIONS

This application claims the benefit of U.S. provisional patent application No. 62/399,177, filed Sep. 23, 2016, which is incorporated by reference.

BACKGROUND

The described embodiments relate generally to electronic connectors such as audio and data connectors for electronic devices and methods and systems for applying lubricants to electronic connectors for electronic devices.

Handheld electronic devices typically have electronic connectors for connecting the devices to other devices for transmitting and receiving audio, video, energy, and/or data. Often, electronic connectors of the handheld electronic devices are disposed in receptacles that receive plug connectors which mate with the electronic connectors in the receptacles to allow this communication with other devices. Because the receptacles are generally open to receive plug connectors, liquid electrolytes (e.g. sweat, water from the ocean or a pool, beverages, etc.) may enter via the receptacle and come in contact with the metal contacts of the electronic connectors in the receptacle. These metal contacts are known to corrode in the presence of liquid electrolytes, particularly when held at an electrical bias. In the case of water resistant handheld electronic devices even more liquid is typically exposed to the receptacles and the potential for corrosion presents an increased risk to the functionality of the device. For example, if the contacts that are used to charge the device fully corrode away due to liquid electrolytes, complete loss of device functionality may result.

SUMMARY

Some embodiments of the present disclosure relate to a method of applying a dielectric lubricant to an electrical connector disposed in a receptacle of a consumer electronic device to prevent corrosion of the contacts of the electrical connector. A lubricant delivery device with a size and shape to match the receptacle and apertures designed for delivering the dielectric lubricant to the electrical connector may be inserted into the receptacle and the dielectric lubricant may be deposited in the receptacle and on the contacts of the electrical connector via the apertures. The dielectric lubricant may remain in the receptacle and on the electrical connector during use of the device and act as a physical barrier keeping liquid electrolytes out of the receptacle and away from the contacts of the electrical connector.

In some embodiments, a method of applying a dielectric lubricant to an electrical connector of a consumer electronic device is provided. The method includes inserting a dielectric lubricant delivery device into a receptacle of the electronic device housing the electrical connector, the lubricant delivery device comprising apertures for delivering the dielectric lubricant to the electrical connector; applying pressure to a chamber including the dielectric lubricant, the chamber being fluidly coupled to the apertures of the lubricant delivery device such that the pressure causes the lubricant to enter the receptacle via the apertures and deposit on contacts of the electrical connector; and pulling vacuum using the lubricant delivery device to remove excess dielectric lubricant from the receptacle and the electrical connector.

According to some embodiments, a method of applying a dielectric lubricant to an electrical receptacle connector of a consumer electronic device to prevent corrosive damage to the contacts of the receptacle connector is provided. The method includes inserting a dielectric lubricant delivery device into a receptacle of the electronic device housing the electrical connector, the lubricant delivery device having a plug portion that extends from a housing and a plurality of apertures formed through a surface of the plug portion, wherein each of the plurality of apertures aligns with one of a plurality of contacts in the electrical receptacle connector when the dielectric delivery device is fully inserted into the receptacle connector; delivering the dielectric lubricant to the electrical receptacle connector by applying pressure to a chamber including the dielectric lubricant, the chamber being fluidly coupled to the apertures of the lubricant delivery device such that the pressure causes the lubricant to enter the receptacle via the plurality of apertures and deposit on the plurality of contacts of the electrical receptacle connector; pulling vacuum using the lubricant delivery device to remove excess dielectric lubricant from the receptacle and the electrical connector; and thereafter, removing the dielectric delivery device from the receptacle connector.

According to some embodiments a method of applying a dielectric lubricant to a receptacle connector of a consumer electronic device that includes a receptacle connector having a first plurality of contacts disposed at a first interior surface of the receptacle connector and a second plurality of contacts disposed at a second interior surface of the receptacle connector opposite the first interior surface is provided. The method includes inserting a plug portion of a dielectric lubricant delivery device into the receptacle connector between the first and second pluralities of contacts, the lubricant delivery device comprising a first plurality of apertures formed through a first exterior surface of the plug portion and a second plurality of apertures formed through a second exterior surface of the plug portion opposite the first exterior surface, wherein each of the first plurality of apertures aligns with one of the first plurality of contacts and each of the second plurality of apertures aligns with one of the second plurality of contacts when the plug portion of the dielectric lubricant delivery device is fully inserted into the receptacle connector; applying pressure to a chamber including the dielectric lubricant, the chamber being fluidly coupled to the apertures of the lubricant delivery device such that the pressure causes the lubricant to enter the receptacle via the apertures and deposit on contacts of the electrical connector; and pulling vacuum using the lubricant delivery device to remove excess dielectric lubricant from the receptacle and the electrical connector.

According to embodiments of the disclosure, dielectric lubricant remaining in the receptacle connector after the delivery device is removed acts as a physical barrier that keeps liquid from causing corrosive damage to the electrical connector and its contacts.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evident to the contrary from the description, where elements in different figures use identical reference numbers, the elements are generally either identical or at least similar in function or purpose.

DETAILED DESCRIPTION

Some embodiments of the present disclosure relate to electronic connectors such as audio and data connectors for electronic devices and to methods and systems for applying lubricants to electronic connectors for electronic devices to protect the connectors from corrosion.

Figure 1:
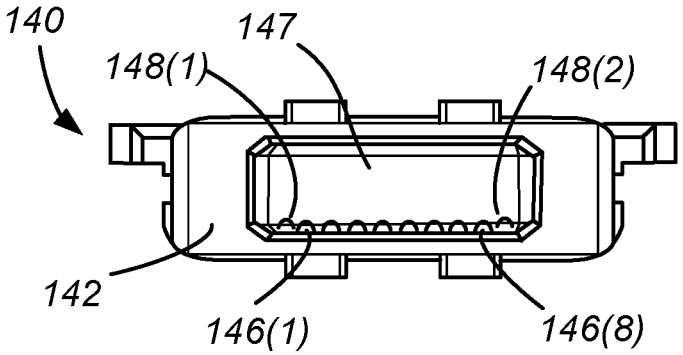
FIG. 1 is a front plan view of a receptacle connector according to some embodiments of the disclosure.

FIG. 1 is a front plan view of a receptacle connector 140 according to embodiments of the disclosure. Receptacle connector 140 may be included in an electronic device to enable an accessory having a plug connector (e.g., plug connector 200 shown in FIG. 2) to be physically coupled to the electronic device. As shown in FIG. 1, receptacle connector 140 may include eight contacts 146(1)-(8) that are spaced apart in a single row. Contacts 146(1)-(8) may be compatible with contacts 201(1)-(8) of plug connector 200 such that audio, video, data, and/or power may be transmitted between contacts 146 and contacts 201 as will be described below with reference to FIG. 2. Receptacle connector 140 may also include two contacts 148(1) and 148(2) that are positioned slightly behind the row of contacts 146(1)-(8) and can be used to detect when connector 200 is inserted within receptacle connector 140. Contacts 146(1)-(8) and contacts 148(1)-(2) are positioned within a cavity 147 that is defined by a housing 142.

Figure 2:
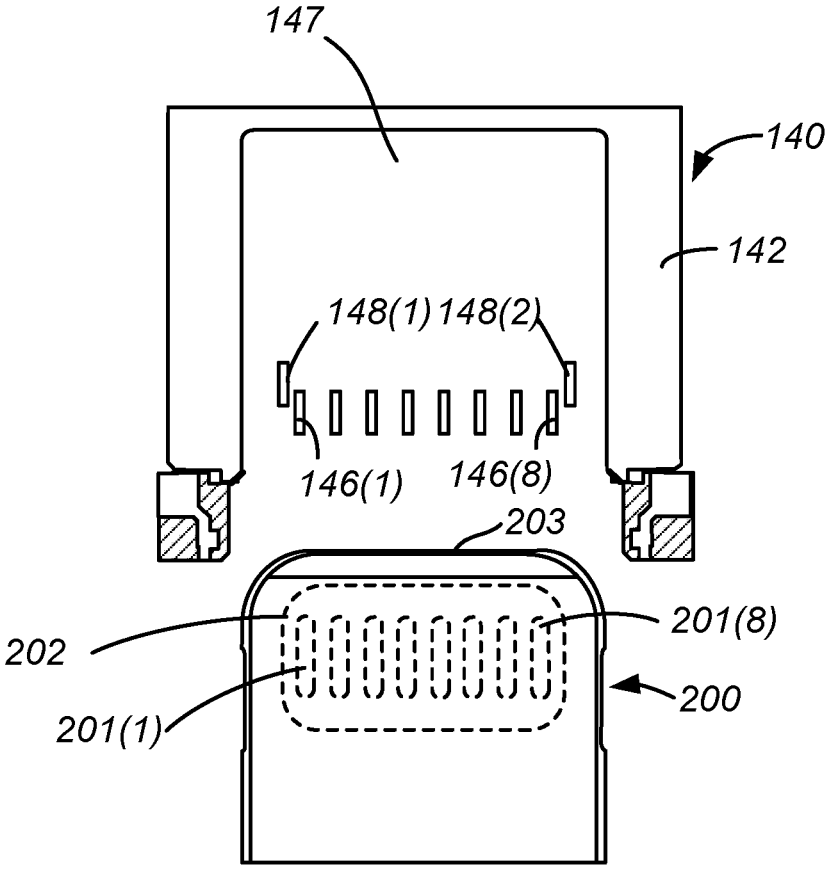
FIG. 2 is a simplified top view of a plug connector and receptacle connector according to some embodiments of the disclosure.

FIG. 2 is a simplified top view of a plug connector 200 and receptacle connector 140 according to embodiments of the disclosure. In some embodiments plug connector 200 may be a Lightning plug available from Apple Inc. of Cupertino Calif. but embodiments of the disclosure are not limited to any particular connector standard. As can be seen in FIG. 2, plug connector 200 may have a contact portion 202 on which contacts 201(1)-(8) are spaced apart in a single row, and a distal end 203 which is inserted into cavity 147 of receptacle connector 140. Contacts 201(1)-(8) are spaced apart to match the spacing of contacts 146(1)-(8) so that when plug 200 is inserted into cavity 147, the contacts align and couple to each other, allowing for transfer of audio, video, data, and/or power as desired. Although not shown in FIG. 2, it will be understood that in some embodiments, plug connector 200 may have two contact portions 202 disposed on opposite ends of connector 200 with corresponding contacts 201 disposed thereon to allow insertion and connection in multiple orientations.

Figure 3A:
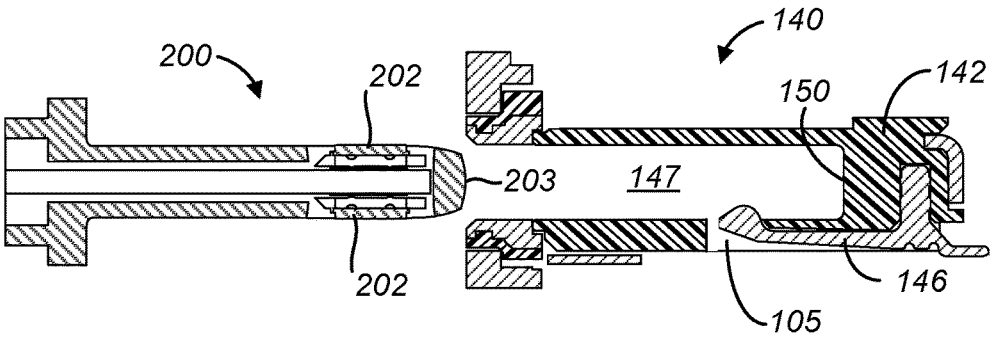
FIGS. 3A-3B are simplified cross-sectional views of the mating process of a plug connector and receptacle connector according to some embodiments of the disclosure.
Figure 3B:
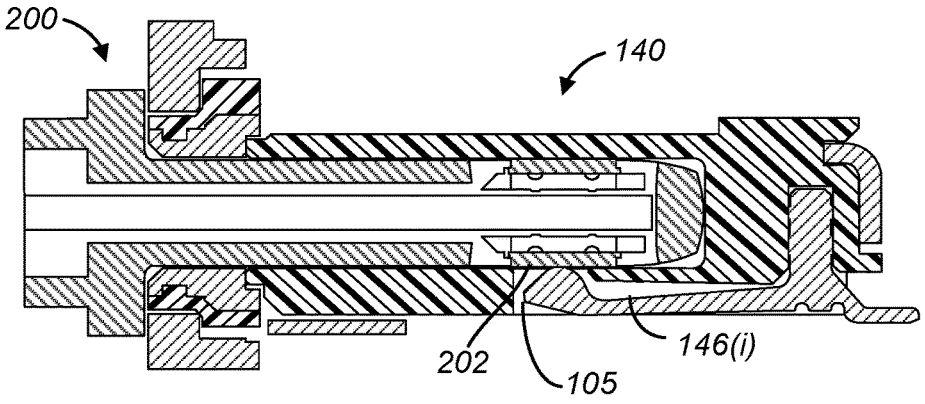

FIGS. 3A-3B are simplified cross-sectional views of the mating process of a plug connector 200 and receptacle connector 140 according to embodiments of the disclosure. FIG. 3A shows the plug connector 200 and receptacle connector 140 prior to insertion of the plug connector 200 into cavity 147 of receptacle connector 140, and FIG. 3B shows the plug connector 200 fully inserted within cavity 147 of receptacle connector 140 such that the distal end 203 is in contact with the stopping surface 150 of cavity 147. As can be seen in FIG. 3B, contact portion 202 (which has contacts 201(1)-(8)) is in contact with contacts 146 of receptacle connector when plug connector 200 is fully inserted within cavity 147. As can also be seen in FIGS. 3A and 3B, electrical connector 146 of receptacle connector 140 may be designed to have a spring bias such that it is in an elevated position when plug connector 200 is not inserted, and it is pushed downwards to a second position (shown in FIG. 3B) when plug connector 200 is inserted. This bias may aid in maintaining contact between contacts 146(1)-(8) and contacts 201(1)-(8) throughout the life of receptacle connector 140.

While the design of receptacle connector 140 described above improves the mating connection between plug connector 200 and receptacle connector 140, it can be seen that the receptacle may have a cavity 105 that allows the translation of electrical connector 146. It will be understood that during normal operation of a device employing receptacle connector 140, e.g., when no plug connector 200 is within receptacle connector 140, cavities 147 and 105 may provide an ingress path for foreign materials. For example, a user's sweat, liquid from a pool or ocean, liquids from a beverage, or other liquids, may easily enter cavity 147 and further settle into cavity 105, surrounding electrical connector 146 and the contacts thereof. As noted above, such liquid electrolytes may cause extensive corrosive damage to electrical connector 146 and the contacts 146(1)-(8). If the liquids fully corrode contacts 146(1)-(8), the device may not be functional, as it may not be connected to a power source to charge. Accordingly, it may be desirable to provide physical barriers to prevent such liquid electrolytes or other corrosive substances to be in contact with electrical connector 146.

In some embodiments, dielectric lubricants may provide a physical barrier that keeps liquid from damaging electrical contacts. Accordingly, it may be desirable to apply such lubricants to the electrical connector 146. Specifically, it may be desirable in some embodiments to apply dielectric lubricants to an electrical connector prior to any use of the connector to make sure no foreign materials enter the receptacle. Thus, it may be desirable to apply the dielectric lubricants at the time of manufacture, and prior to testing and use of a device with a receptacle connector such as receptacle connector 140. In many embodiments, electrical connectors such as electrical connector 146 are attached to device components using reflow soldering. Such reflow soldering exposes the connectors to temperatures close to 250° C. While it may be easier to apply dielectric lubricants prior to this soldering when the connectors are separate components, many desirable dielectric lubricants cannot withstand the high temperatures of reflow soldering, often beginning to break down and lose their beneficial properties at temperatures close to 205° C. Accordingly, in some embodiments, dielectric lubricants may be applied after reflow soldering and assembly, but before testing. Devices and methods for applying the dielectric lubricants will be described with reference to FIGS. 4-8 below.

Figure 4:
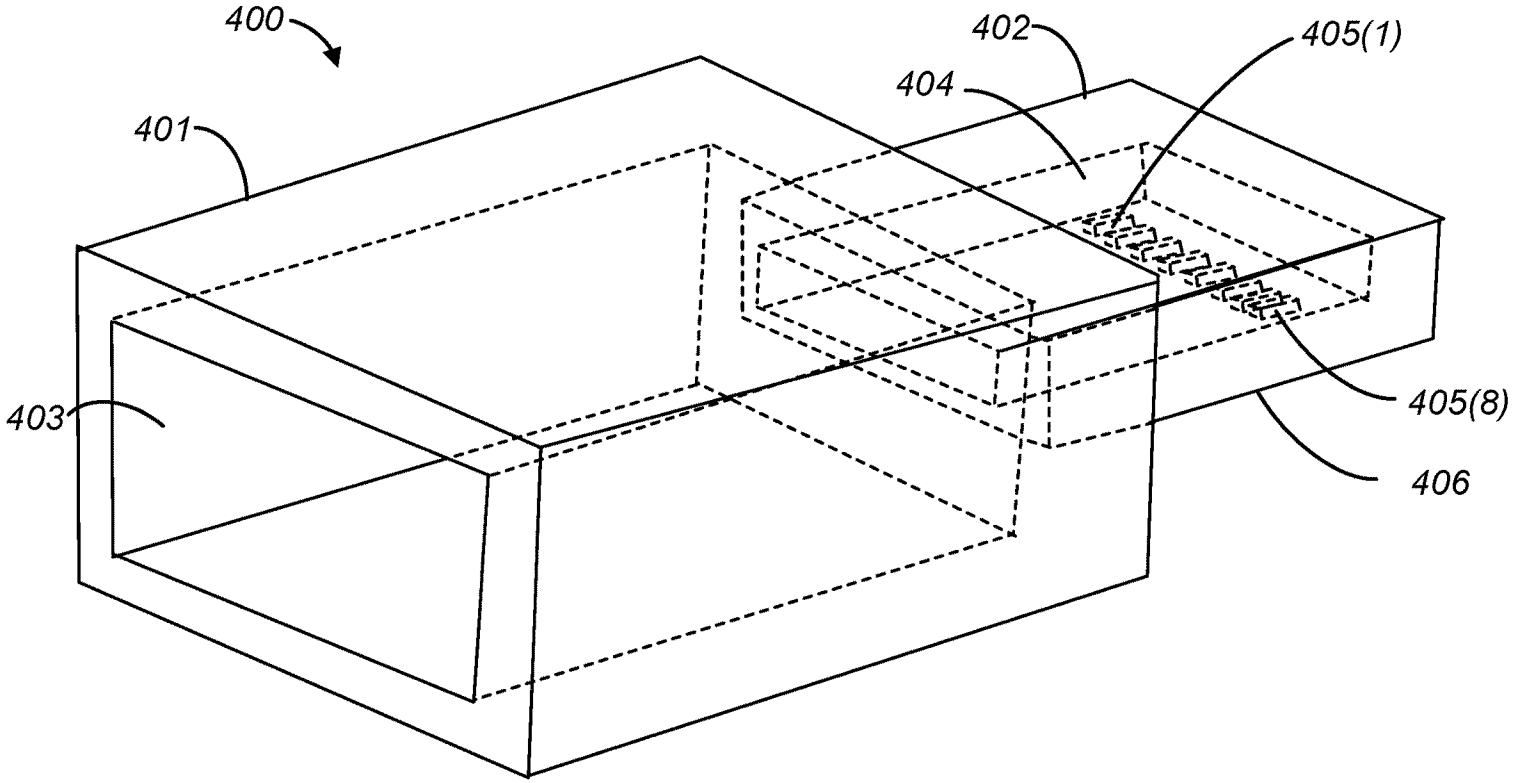
FIG. 4 is a simplified isometric view of a lubricant delivery device according to some embodiments of the disclosure.

FIG. 4 is a simplified isometric view of a lubricant delivery device 400 according to embodiments of the disclosure. As can be seen in FIG. 4, lubricant delivery device 400 may have a housing 401 from which a plug portion 402 extends. Plug portion 402 may have the same general geometry as plug connector 200, which, as described above, may be a Lightning plug available from Apple Incorporated of Cupertino Calif. Although described in terms of plug connector 200 and receptacle connector 140, it will be understood that embodiments of the disclosure are not limited to such and plug portion 402 may be designed to have the same geometry as any plug connector that mates with the receptacle connector that device 400 is being used with, to allow appropriate insertion as will be described below.

Housing 401 may have a chamber 403 and plug portion 402 may have a chamber 404 that is fluidly coupled to chamber 403. In some embodiments, chamber 403 may have a dielectric lubricant loaded therein that may travel from chamber 403 to chamber 404. Although shown as open, it will be understood that chamber 403 may have any suitable enclosure that allows for loading of dielectric lubricant. Plug portion 402 may include a number of apertures or ports 405 that extend from chamber 404 to the bottom surface 406 of plug portion 402. As depicted herein, plug portion 402 has eight apertures 405(1)-(8) to match the number of electrical contacts of plug connector 200 and receptacle connector 140. Apertures 405(1)-(8) may define the exit path for the dielectric lubricant from device 400. In order to ensure that the electrical contacts are covered with dielectric lubricant to protect from corrosion, the geometry, including the shape, size, and spacing, of apertures 405(1)-(8) may match the geometry of contacts 201(1)-(8) of plug connector 200.

In order to control the flow of lubricant within device 400, lubricant delivery device 400 may be coupleable to a pressure source and/or a vacuum source. The pressure source may be configured to apply a desired amount of pressure to chamber 403 to force dielectric lubricant therein to chamber 404 and out of device 400 through apertures 405(1)-(8). In some embodiments, the pressure applied and duration of pressure may be precisely controlled to deposit a desired volume of lubricant. In some embodiments, controlled volumetric dispensing may be accurate to ±0.2 $mm^3$. The vacuum source may be configured to pull vacuum so as to draw excess lubricant surrounding plug portion 402. As with pressure source, the vacuum source may be controlled to desired parameters to draw the desired amount of lubricant, in some embodiments.

Figure 5:
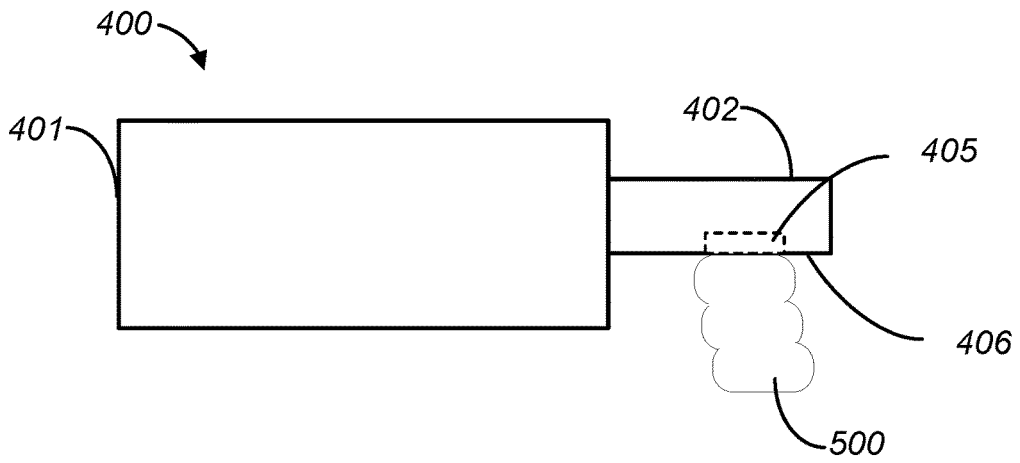
FIG. 5 is a simplified side view of a lubricant delivery device delivering lubricant according to some embodiments of the disclosure.
Figure 6:
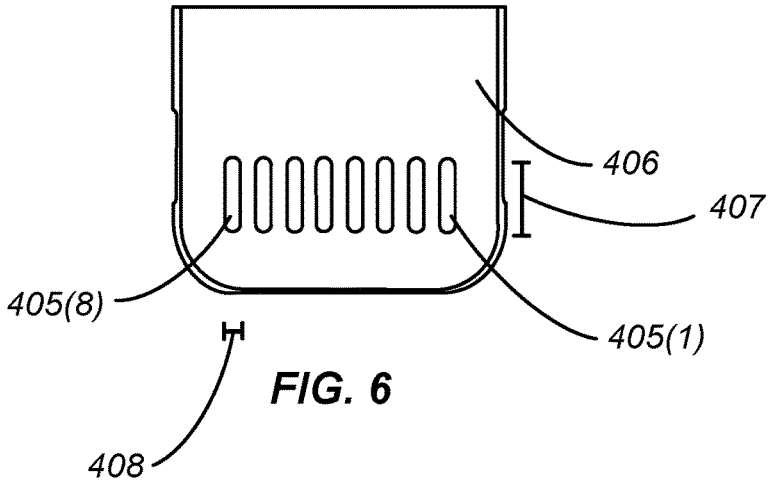
FIG. 6 is a simplified bottom view of apertures of a plug portion of a lubricant delivery device according to some embodiments of the disclosure.

FIG. 5 is a simplified side view of a lubricant delivery device 400 delivering lubricant 500 according to embodiments of the disclosure. As can be seen in FIG. 5, lubricant may exit device 400 from the bottom surface 406 via apertures 405. FIG. 6 is a simplified bottom view of apertures 405(1)-(8) of a plug portion 402 of a lubricant delivery device 400 according to embodiments of the disclosure. As can be seen, apertures 405(1)-(8) may have openings that are shaped, sized, and spaced apart in the same way as contacts 201(1)-(8) of plug connector 200 shown in FIG. 2. This may ensure that lubricant is deposited directly over electrical contacts 146(1)-(8) when device 400 is inserted in cavity 147 of receptacle connector 140. In some embodiments, the length 407 of apertures may be approximately 1.48 mm, and the width 408 of apertures may be approximately 0.30 mm.

Figure 7:
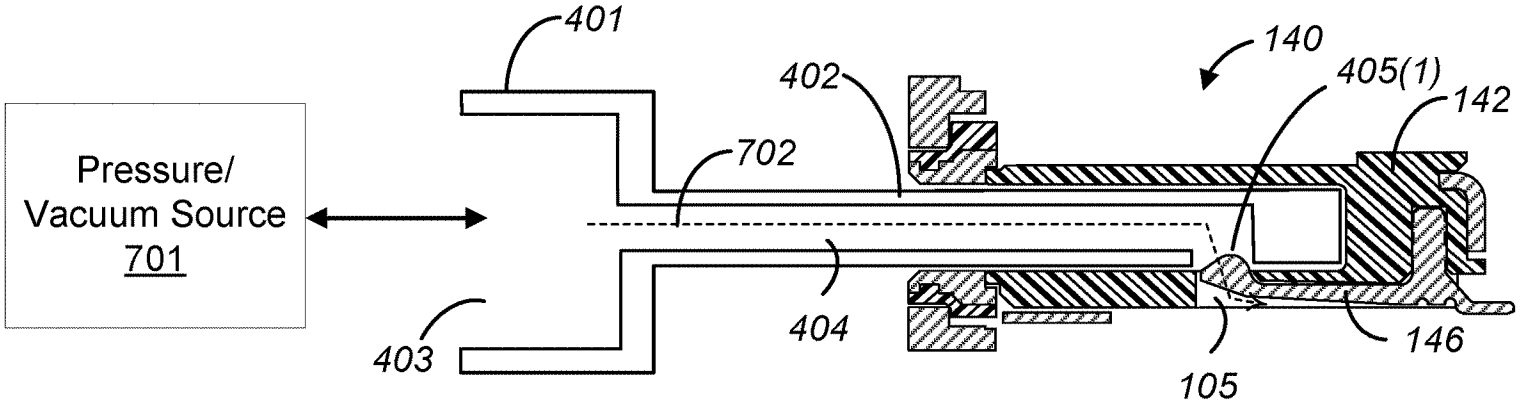
FIG. 7 is a simplified cross-sectional view of lubricant delivery device delivering lubricant to a receptacle connector according to some embodiments of the disclosure.

FIG. 7 is a simplified cross-sectional view of lubricant delivery device 400 delivering lubricant to a receptacle connector 140 according to embodiments of the disclosure. As can be seen in FIG. 7, when plug portion 402 is received in cavity 147 of receptacle connector 140, apertures 405(1)-(8) may be aligned with electrical contacts 146(1)-(8). When pressure source 701 is activated, dielectric lubricant in chamber 403 may pass through chamber 404 and apertures 405 down to electrical connector 146 and cavity 105, as shown by the path of arrow 702. In some embodiments, a particular volume of dielectric lubricant corresponding to/or determined based on the volume of cavity 105 may dispensed by precise control of the pressure of pressure source 701 and/or the duration of pressure applied. In some embodiments, the volume deposited may be approximately 6.7 $mm^3$. To the extent excess dielectric lubricant may be deposited on the tip of electrical connector 146 such that lubricant would be visible outside the receptacle and otherwise interfere with the use of receptacle connector 140, vacuum source 701 may be used to precisely draw such excess lubricant as desired.

Figure 8:
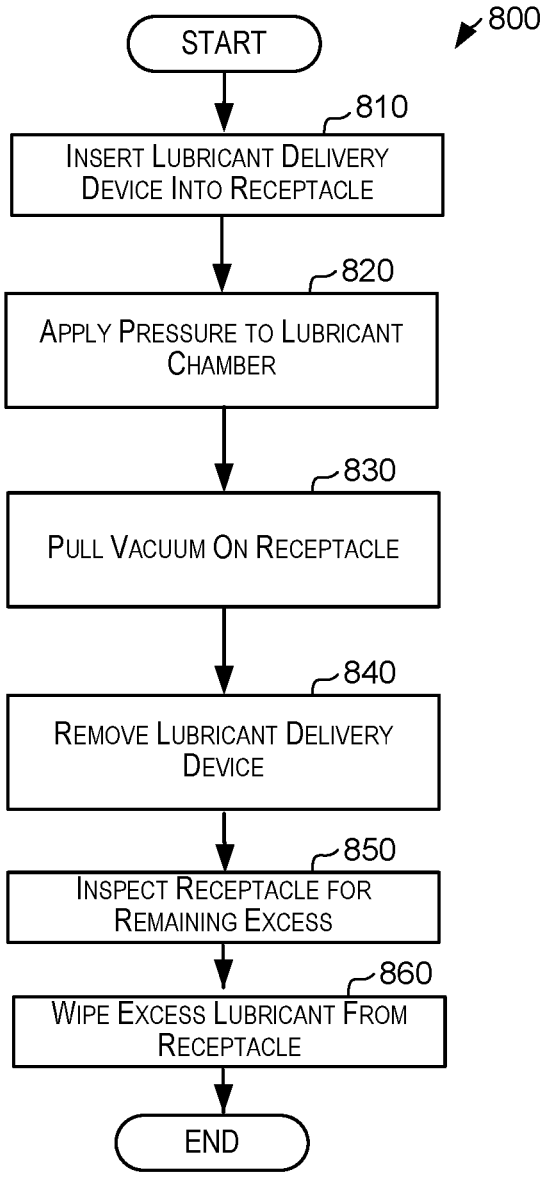
FIG. 8 is a flow chart showing a method of applying a lubricant to an electrical connector according to some embodiments of the disclosure.

FIG. 8 is a flow chart showing a method 800 of applying a lubricant to an electrical connector according to embodiments of the disclosure. It will be understood by those skilled in the art that the order of the steps may be switched, some of the steps may be combined, and/or some of the steps may be optional. The flowchart of FIG. 8 is one example of the method and is not intended to be limiting. Thus, it will be understood by those skilled in the art that various other operation(s) disclosed in this application may be used instead of those shown in FIG. 8. The steps will now be described with reference to FIG. 8.

At step 810, a lubricant delivery device such as device 400 described above may be inserted into cavity 147 of receptacle connector 140. Device 400 may be inserted fully so that apertures 405 are aligned with electrical contacts 146. Device 400 may be preloaded with dielectric lubricant within chamber 403. The dielectric lubricant should be sufficiently viscous that the lubricant remains in place in the receptacle connector and the properties of the lubricant should prevent it from melting at expected operating temperatures of any device that the receptacle connector is included within. In some embodiments the dielectric lubricant is a silicon lubricant compound. One suitable such lubricant is Loctite® Dielectric Grease manufactured by Henkel Corp. In some embodiments, it may be desirable to use an optically clear dielectric lubricant for cosmetic purposes. For example, the dielectric lubricant may be LS1246 available from NuSil Technology LLC.

At step 820, pressure may be applied to the chamber of delivery device with dielectric lubricant in it. As described above, the pressure and time of application of pressure source 701 may be precisely controlled to control the volume of dielectric lubricant deposited. The pressure may cause dielectric lubricant to exit via apertures 405 onto electrical contacts 146. The lubricant may act as a physical barrier to prevent corrosion of the electrical contacts.

At step 830, a slight vacuum may be pulled on the receptacle from device 400 to remove excess lubricant from cavity 147 and/or electrical connector 146. Removing excess lubricant at this step may ensure that the device 400 may be removed with minimal contamination of receptacle connector 140, and that lubricant is generally not visible to users from outside of receptacle connector 140.

At step 840, device 400 may be removed from cavity 147. Once removed, at step 850, the receptacle may be cosmetically inspected for remaining excess lubricant, and at step 860, any remaining excess lubricant may be wiped from receptacle and surrounding areas. In some embodiments, a particular device may be used to wipe the receptacle. For example, a wiping device with a plug portion shaped to enter the receptacle but made of a spongy absorbable material may be inserted and removed to wipe excess lubricant. The device may be shaped so as not to remove lubricant from the portions of the receptacle and/or electrical connector on which lubricant is desired.

It will be understood that once the dielectric lubricant is in place, it may act as a physical barrier keeping liquids and other foreign material away from the electrical contacts of electrical connector 146. When an actual plug 200 is inserted, the lubricant may naturally wipe away from the contacts to allow connection between contacts 201 and 146, and when the plug 200 is removed, the lubricant may naturally return to cover contacts of electrical connector 146. Thus, reapplication of the dielectric lubricant may not be necessary to continue to prevent corrosion.

Figure 9:
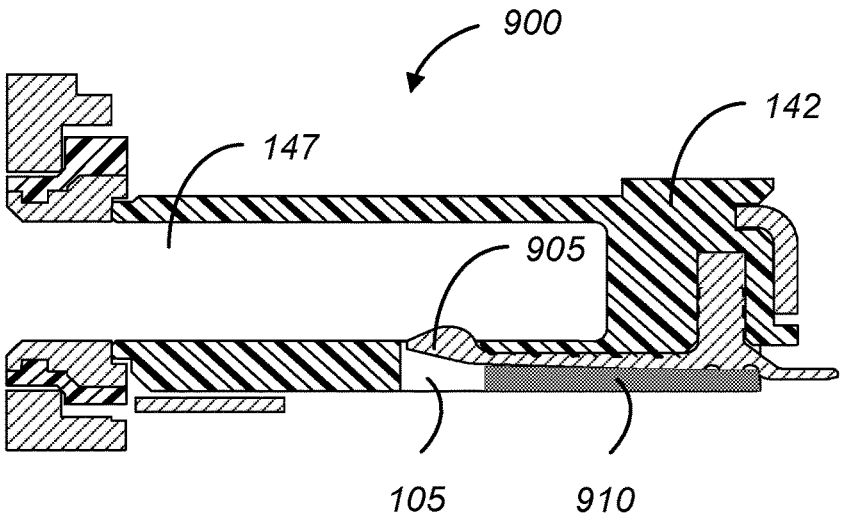
FIG. 9 is a simplified cross sectional view of a receptacle connector according to some embodiments of the disclosure.

In some embodiments, it may be desirable to modify the receptacle connector components to prevent corrosion. FIG. 9 is a simplified cross sectional view of a receptacle connector 900 according to embodiments of the disclosure. Receptacle connector 900 may be similar to receptacle connector 140, except that cavity 105 may be partially filled with a compliant material 910. For example, in some embodiments, cavity 105 described above may be minimized by affixing compliant material 910 to the bottom of electrical connector 905. In some embodiments, material 910 may be a silicone or other polymer molded to electrical connector 905. This may have the benefit of keeping electrical connector 905 in position which may reduce or eliminate the opening to cavity 105 such that liquids cannot enter as easily and come in contact with the electrical contacts of electrical connector 905. The material 910 may be compliant to allow electrical connector to deflect slightly when a plug connector is received. In some embodiments, to further protect from corrosion, some or all of electrical connector 905 may be made of material that has increased corrosion resistance properties. For example, some or all of electrical connector 905 may be made of materials that do not corrode as easily. As one example, Paliney 7, an alloy available from Deringer-Ney Incorporated, or other similar materials, may be used for some or all of electrical connector 905. For example, the electrical contact portion of electrical connector 905 may be made of Paliney 7 to improve corrosion resistance. Alternatively, some or all of electrical connector 905 may be coated using electrophoretic deposition to make electrical connector 905 more resistant to corrosion. It will be understood that electrophoretic deposition may allow the coating to be thin enough to be applied to electrical contacts without causing other issues.

Figure 10:
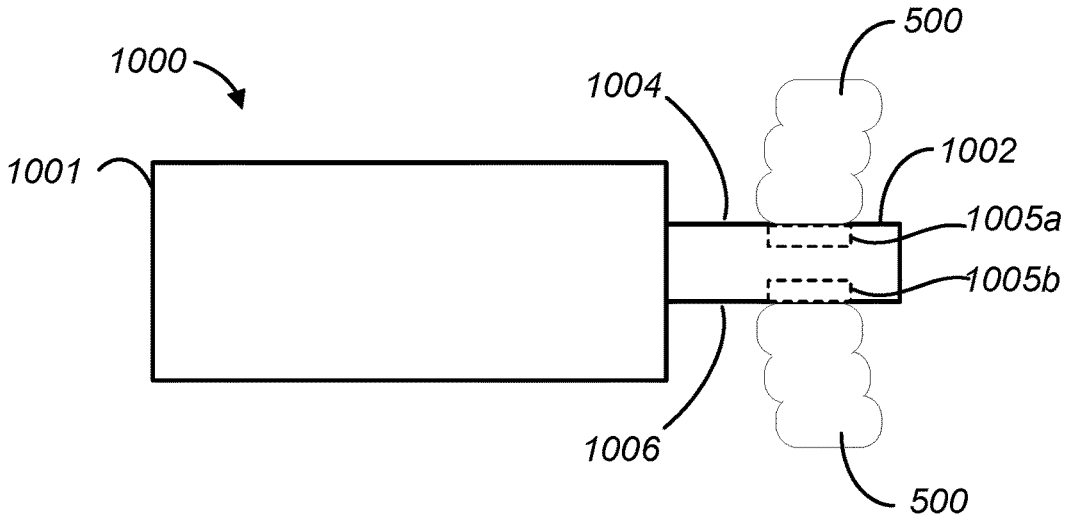
FIG. 10 is a simplified side view of a lubricant delivery device delivering lubricant according to some embodiments of the disclosure.

Additionally, in some embodiments the receptacle connector may include contacts on opposing sides (for example, upper and lower contacts) of the receptacle connector. Some embodiments of the disclosure pertain to a lubricant delivery device that can simultaneously deliver lubricant to both the upper and lower contacts. For example, FIG. 10, which is a simplified side view of a lubricant delivery device 1000 according to some embodiments of the disclosure. Lubricant delivery device 1000 includes a plug portion 1002 that extends from a housing 1001 similar to delivery device 500 discussed above with respect to FIG. 5. Lubricant delivery device 1000, however, is able to deliver lubricant 500 through apertures 1005*a* formed at a top surface 1004 and through apertures 1005*b* formed at a bottom surface 1006 of plug 1002. The lubricant can be delivered through both sets of apertures 1005*a*, 1005*b* using the same delivery method discussed above with respect to FIG. 8, and each set of apertures 1005*a*, 1005*b* can be similar to apertures 405(1)-405(8) described above or can include any number of apertures having an appropriate shape, size and spacing for the particular receptacle connector that lubricant delivery device 1000 is to be used with.

In the foregoing specification, embodiments of the disclosure have been described with reference to numerous specific details that may vary from implementation to implementation. The specification and drawings are, accordingly, to be regarded in an illustrative rather than a restrictive sense. The sole and exclusive indicator of the scope of the disclosure, and what is intended by the applicants to be the scope of the disclosure, is the literal and equivalent scope of the set of claims that issue from this application, in the specific form in which such claims issue, including any subsequent correction. The specific details of particular embodiments may be combined in any suitable manner without departing from the spirit and scope of embodiments of the disclosure. For example, while embodiments of the disclosure are described above with respect to an eight contact connector that conforms to the Lightning connector pinout developed by Apple Inc., embodiments of the disclosure are not limited to any specific connector standard and can be used with connectors having fewer or more than eight contacts and connectors that comply with standards or pinouts different than the Lightning connector. Additionally, spatially relative terms, such as "bottom or "top" and the like may be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as a "bottom" surface may then be oriented "above" other elements or features. The device may be otherwise oriented (e.g., rotated 90 degrees or at other orientations) and the spatially relative descriptors used herein interpreted accordingly.

What is claimed is:

1. A method of applying a dielectric lubricant to an electrical receptacle connector of a consumer electronic device to prevent corrosive damage, the receptacle connector including a body that defines a first cavity, a second cavity fluidly coupled to the first cavity and a plurality of electrical contacts each of which includes an end portion that extends into the first cavity and that translates within the second cavity, the method comprising:

inserting a dielectric lubricant delivery device into the first cavity of the receptacle connector of the electronic device, the lubricant delivery device comprising a plurality of apertures formed through a surface of the dielectric lubricant delivery device, wherein each of the plurality of apertures aligns with one of the plurality of electrical contacts when the dielectric delivery device is fully inserted into the receptacle connector;

applying pressure to a chamber including the dielectric lubricant, the chamber being fluidly coupled to the apertures of the lubricant delivery device such that the pressure causes the lubricant to enter the receptacle via the plurality of apertures and deposit around the end portion of each of the plurality of contacts of the electrical connector and within the second cavity; and pulling vacuum using the lubricant delivery device to remove excess dielectric lubricant from the electrical receptacle connector;

wherein, the dielectric lubricant remaining in the electrical receptacle connector acts as a physical barrier between liquid that enters the electrical receptacle connector and portions of the plurality of contacts.

2. The method of claim 1 wherein the dielectric lubricant is a silicon dielectric grease.

3. The method of claim 1 wherein the dielectric lubricant is optically clear.

4. The method of claim 3 wherein the dielectric lubricant is LS1246.

5. The method of claim 1 further comprising:

removing the lubricant delivery device from the receptacle of the electronic device after pulling vacuum; and wiping remaining excess lubricant from the electrical connector.

6. The method of claim 1 further comprising visually inspecting the first cavity of the electronic device to confirm that excess lubricant has been removed.

7. The method of claim 1 wherein applying pressure to the chamber comprises applying a predetermined amount of pressure for a predetermined amount of time so as to dispense a volume of dielectric lubricant necessary to fill the receptacle of the electronic device.

8. A method of applying a dielectric lubricant to an electrical receptacle connector of a consumer electronic device to prevent corrosive damage, the receptacle connector including a body that defines a first cavity, a second cavity fluidly coupled to the first cavity and a plurality of electrical contacts each of which includes an end portion that extends into the first cavity and that translates within the second cavity, the method comprising:

inserting a dielectric lubricant delivery device into the first cavity of the receptacle connector of the electronic device, the lubricant delivery device having a plug portion that extends from a housing and a plurality of apertures formed through a surface of the plug portion, wherein each of the plurality of apertures aligns with one of a plurality of contacts in the electrical receptacle connector when the dielectric delivery device is fully inserted into the receptacle connector;

delivering the dielectric lubricant to the electrical receptacle connector by applying pressure to a chamber including the dielectric lubricant, the chamber being fluidly coupled to the apertures of the lubricant delivery device such that the pressure causes the lubricant to enter the receptacle via the plurality of apertures and deposit on the plurality of contacts of the electrical receptacle connector;

pulling vacuum using the lubricant delivery device to remove excess dielectric lubricant from the receptacle and the electrical connector; and thereafter, removing the dielectric delivery device from the receptacle connector;

wherein, the dielectric lubricant remaining in the receptacle acts as a physical barrier that keeps liquid from causing corrosive damage to the electrical connector.

9. The method of claim 8 wherein applying pressure to the chamber comprises applying a predetermined amount of pressure for a predetermined amount of time so as to dispense a volume of dielectric lubricant necessary to fill the receptacle of the electronic device.

10. The method of claim 8 further comprising wiping remaining excess lubricant from the electrical connector.

11. The method of claim 8 wherein the dielectric lubricant is a silicon dielectric grease.

12. The method of claim 8 wherein the dielectric lubricant is optically clear.

13. The method of claim 12 wherein the dielectric lubricant is LS1246.

14. The method of claim 8 wherein:

the receptacle connector includes a first plurality of contacts disposed at a first interior surface of the receptacle connector and a second plurality of contacts disposed at a second interior surface of the receptacle connector opposite the first interior surface;

the lubricant delivery device includes a first plurality of apertures formed through a first exterior surface of the plug portion and a second plurality of apertures formed through a second exterior surface of the plug portion opposite the first exterior surface; and when the electrical receptacle connector when the dielectric delivery device is fully inserted into the receptacle connector, each of the first plurality of apertures aligns with one of the first plurality of contacts and each of the second plurality of apertures aligns with one of the second plurality of contacts.

15. The method of claim 8 wherein the apertures in the lubricant delivery device are spaced apart, shaped and sized to match electrical contacts of a plug connector that mates with the electrical connector such that when dielectric lubricant is dispensed through the apertures the dielectric lubricant precisely covers the electrical contacts of the electrical connector.

16. A method of applying a dielectric lubricant to a receptacle connector of a consumer electronic device to prevent corrosive damage, the receptacle connector including a body that defines a first cavity, a first plurality of contacts disposed at a first interior surface of the receptacle connector and a second plurality of contacts disposed at a second interior surface of the receptacle connector opposite the first interior surface, wherein each of the first plurality of contacts includes an end portion that extends into the first cavity and translates during a mating event into a recess in the body and each of the second plurality of contacts includes an end portion that extends into the first cavity and translates during a mating event into a recess in the body, the method comprising:

inserting a plug portion of a dielectric lubricant delivery device into the receptacle connector between the first and second pluralities of contacts, the lubricant delivery device comprising a first plurality of apertures formed through a first exterior surface of the plug portion and a second plurality of apertures formed through a second exterior surface of the plug portion opposite the first exterior surface, wherein each of the first plurality of apertures aligns with one of the first plurality of contacts and each of the second plurality of apertures aligns with one of the second plurality of contacts when the plug portion of the dielectric lubricant delivery device is fully inserted into the receptacle connector;

applying pressure to a chamber including the dielectric lubricant, the chamber being fluidly coupled to the apertures of the lubricant delivery device such that the pressure causes the lubricant to enter the receptacle via the apertures and deposit on contacts of the electrical connector; and pulling vacuum using the lubricant delivery device to remove excess dielectric lubricant from the receptacle and the electrical connector;

wherein, the dielectric lubricant remaining in the receptacle acts as a physical barrier that keeps liquid from causing corrosive damage to the electrical connector.

17. The method of claim 16 wherein the dielectric lubricant is a silicon dielectric grease.

18. The method of claim 16 wherein the dielectric lubricant is optically clear.

* * * * *